United States Patent [19]

Waddell

[11] 3,964,198

[45] June 22, 1976

[54] FIREARM EXTRACTOR/EJECTOR SYSTEM

[75] Inventor: Richard G. Waddell, Phoenix, Ariz.

[73] Assignee: The Innovation Resources Corporation, Tempe, Ariz.

[22] Filed: Sept. 5, 1974

[21] Appl. No.: 503,299

[52] U.S. Cl. ..... 42/48; 42/46

[51] Int. Cl.[2] ..... F41C 15/06

[58] Field of Search ..... 42/46–48

[56] References Cited

UNITED STATES PATENTS 858,674 7/1907 Schafer ..... 42/48

*Primary Examiner*—Charles T. Jordan

*Attorney, Agent, or Firm*—Cahill, Sutton & Thomas

[57] ABSTRACT

An extractor/ejector system is described for automatically extracting a cartridge from the breech of a firearm or automatically ejecting the cartridge when the cartridge has been fired. A gas port is provided in the barrel of the arm to direct gases from the barrel against a piston: a piston rod connected to the piston contacts a sear and is forced into a latched position with an extractor/ejector spring in compressed condition. When the action of the firearm is broken, a lug is provided for contacting an extractor having a camming surface contacting the sear. The motion of the extractor caused by the lug forces the sear out of engagement, permitting the ejector spring to rapidly expend and effectively eject the fired cartridge. When the cartridge has not been fired, no gases are directed against the piston and the ejector sear remains in an unlatched position, permitting the ejector spring to gently extract the cartridge as the action is broken; the unfired cartridge remains in the breech of the barrel and is not ejected.

4 Claims, 8 Drawing Figures

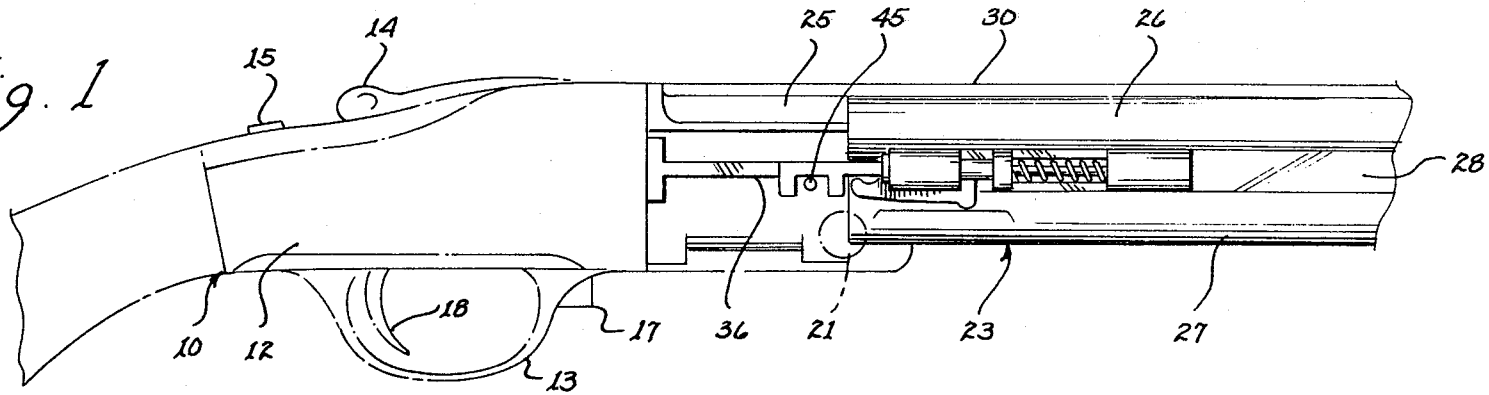
fig. 1
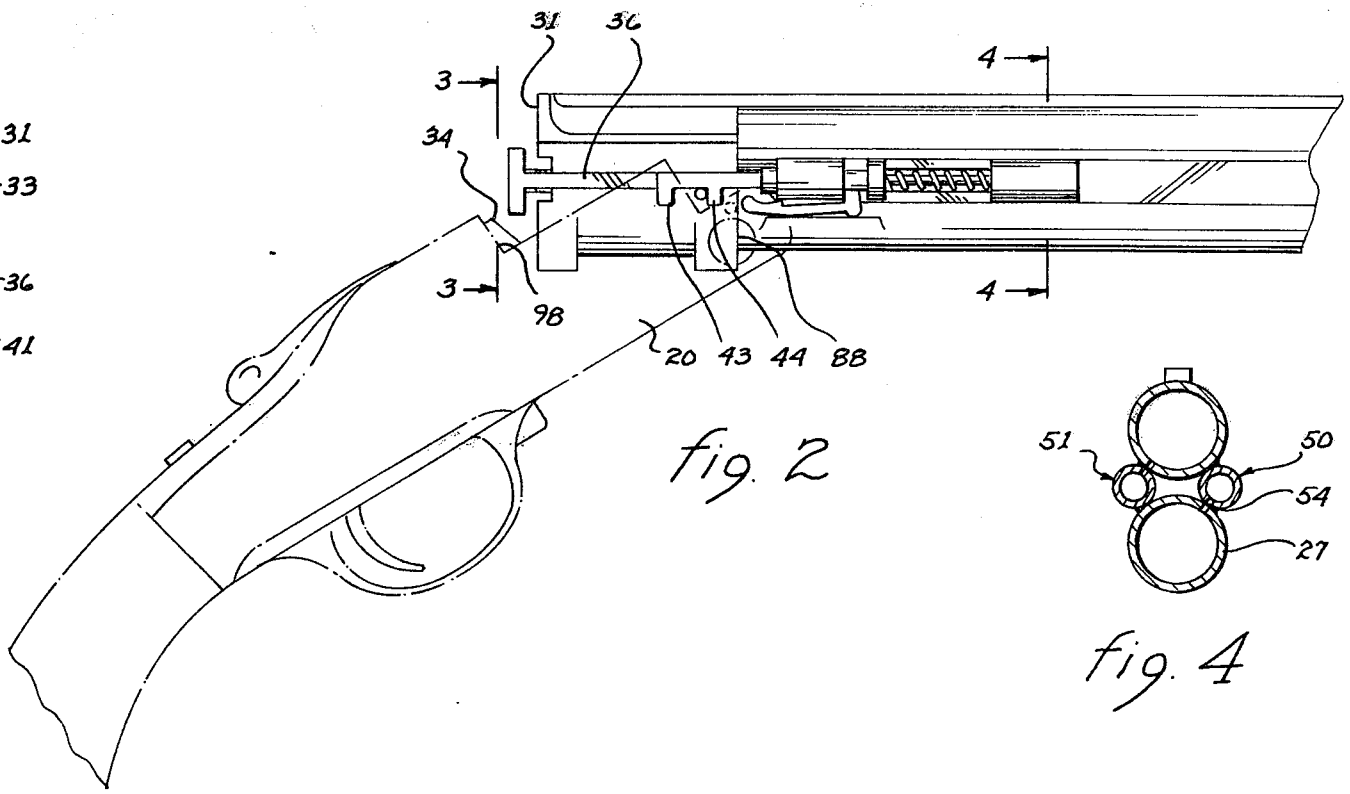
fig. 2
fig. 4
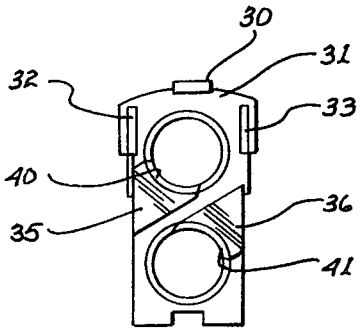
fig. 3

FIREARM EXTRACTOR/EJECTOR SYSTEM

The present invention pertains to extractor/ejector mechanisms and more specifically to such a system that will automatically extract an unfired cartridge and will eject a fired cartridge.

In firearms, particularly shotguns of the break-open type, it is desirable to provide an extractor that, upon breaking the action, will gently lift the cartridge in the barrel breech slightly outwardly to permit the cartridge to be grasped by the operator and removed. When the cartridge has been fired, it is also desirable not only to extract but also to eject the fired cartridge from the breech to permit rapid reloading of the firearm.

Typical extractor configurations incorporate means for engaging the cartridge rim (if the firearm uses rimmed cartridges). or for contacting the annular groove in the base of the cartridge (if rimless cartridges are used by the firearm). These extractors are generally cammed into movement axially of the barrel and rearwardly thereof as the break-open action is broken. To provide sufficient force to eject the cartridge, and to provide a means for automatically detecting when the cartridge has been fired, has encompassed a variety of relatively complicated mechanisms. The complexity of the mechanisms has affected the reliability and cost of the firearm. Recoil operated extractors/ejectors as well as numerous mechanisms keyed to trigger sears, trigger groups or hammers have been proposed in the prior art.

The above types of extractor/ejector mechanisms become increasingly troublesome when the firearm on which they are to be used is a double-barrel firearm where it is desired to extract the unfired cartridge in one barrel while simultaneously ejecting the fired cartridge in the other.

It is therefore an object of the present invention to provide an extractor/ejector system for use on a break-open type firearm that automatically extracts or ejects, depending on the fired or unfired condition of the cartridge.

It is another object of the present invention to provide an extractor/ejector system for use in a break-open type firearm that is simple and extremely reliable.

It is still another object of the present invention to provide an extractor/ejector system for use in a break-open type firearm that is compact and may be incorporated in a firearm without unduly adding to the bulk or weight of the firearm.

These and other advantages of the present invention will become apparent to those skilled in the art as the description thereof proceeds.

The present invention may more readily be described by reference to the accompanying drawings, in which:

FIG. 1 is a side-elevational view of an over/under break-open type firearm incorporating the teachings of the present invention.

FIG. 2 is a diagram of the apparatus of FIG. 1 showing the firearm in the broken position.

FIG. 3 is a cross-sectional view of FIG. 2 taken along line 3—3.

FIG. 4 is a cross-sectional view of FIG. 2 taken along line 4—4.

Figure 5:
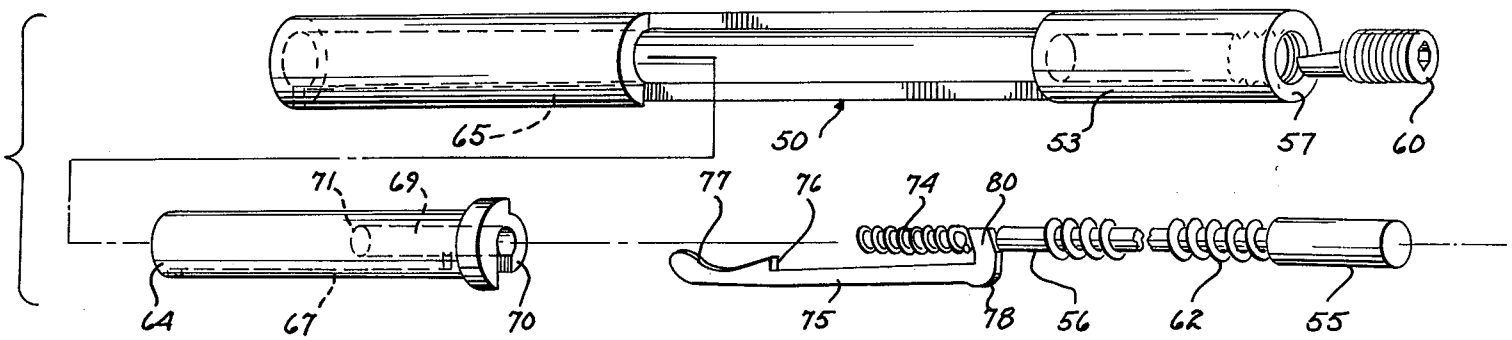
FIG. 5 is an exploded perspective view of portions of the apparatus of the present invention.

Referring now to the drawings, and particularly to drawings 1 through 5, a typical break-open type firearm 10 is shown of the over/under variety having a receiver 12, trigger guard 13, locking lever 14, barrel selector 15, safety latch 17, and trigger 18. The receiver 12 may be of the one piece variety having side plates 20 extending forwardly, said side plates including trunnions 21 which act as pivot points for a barrel group 23. The firearm shown in FIGS. 1 and 2 is shown without a forearm to expose those portions of the firearm pertinent to the present invention.

The barrel group 23, in the embodiment chosen for illustration, includes a monoblock 25 to which is secured in a well-known manner barrels 26 and 27. The barrels may be joined by a web such as that shown in 28 and the upper barrel may support a sighting rib 30. The breech 31 of the barrels may include recesses 32 and 33 to receive locking lugs 34, the latter being spring loaded and mounted in the receiver 12 to lock the barrel group in a closed position. The extractors/ejectors 35 and 36 are slidably mounted in the monoblock 25 in a dove-tailed groove provided therefor; the extractors/ejectors 35 and 36 include cartridge engaging edges 40 and 41 respectively which engage the annular groove in the base of a rimless cartridge or engage the rim of a rimmed cartridge when such cartridges are inserted in the breech of the barrels. The extractors/ejectors such as 36 are permitted only limited longitudinal movement along the monoblock 25 since extensions 43 and 44 extend downwardly from the extractor/ejector on either side of flank pin 45 which limits such movement by abutting the extensions at the limits of travel.

Secured to the side of the barrels 26 and 27, and positioned intermediate the two barrels, is a housing tube 50; although two such housing tubes 50 and 51 are used in the double-barreled embodiment chosen for illustration, only the housing tube 50 and mechanisms associated therewith will be described. It will be understood that identical mechanism will be used in connection with the housing tube 51. The housing tube 50 is secured such as by welding or brazing to the side of the firearm and is conveniently positioned in an intermediate position between the barrels 26 and 27. The housing tube 50 forms a cylinder 53 at one end thereof which communicates with the interior of the barrel 27 through a gas port 54. The cylinder 53 houses a piston 55 and piston rod 56 and is closed at the end 57 opposite the piston 55 by a split end plug 60. An extractor/ejector spring 62 is mounted over the piston rod 56. The opposite end of the housing tube 50 slidably encloses an anvil 64 and also provides a slot 65 extending longitudinal and beneath for purposes that will become apparent as the description proceeds.

The anvil 64 is cylindrical and includes a slot 67 extending longitudinally thereof as well as a cylindrical bore 69 extending co-axially therewith from the face 70 and terminating at the bore bottom 71. A sear spring 74 is positioned within the bore 69 while the slot 67 as well as the slot 65 in the housing tube 50 provide a guiding channel for a sear 75. The sear includes a latching surface 76, a camming surface 77, a pivoting surface 78, and an operating arm 80.

The extractor/ejector 36 includes a camming surface 82 which mates with the camming surface 77 of the sear 75. A lug 85 formed in the monoblock 25 is used to contact the extension 44 to force the extractor/ejector 36 rearwardly as the action is broken.

The operation of the system of the present invention may now be described with particular reference to FIGS. 6, 7 and 8; in FIGS. 6, 7 and 8 the barrels are not shown and the monoblock has been eliminated to make the explanation of operation more clear. However, the front edge 88 of the monoblock 25 has been shown to permit reference thereto during operation of the apparatus.

Figure 6:
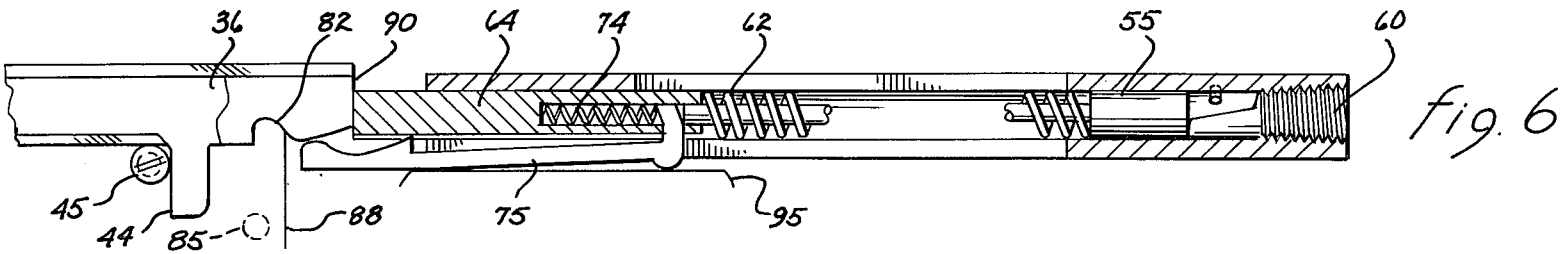
FIGS. 6, 7 and 8 are side-elevational views, particularly of the extractor/ejector system in different stages of its operation.

Referring to FIG. 6, the apparatus of the present invention is shown in the position that it would assume when the firearm action has been broken; the breech is open and the extractor/ejector is in its extended position. In this position, it may be seen that the extension 44 of the extractor/ejector 36 has extended rearwardly as far as possible and has abutted the flank pin 45. The extractor/ejector spring 62 is exerting force between the piston 55 and the anvil 64, the former butting against the split end block plug 60 and the latter butting against the rear face 90 of the extractor/ejector 36, causing it to extend rearwardly to its extended position. The sear spring 74 maintains the sear 75 in a forward position in the slot 67 of the anvil 64. As the action of the firearm is closed, the elements of the apparatus assume the position shown in FIG. 7.

Figure 7:
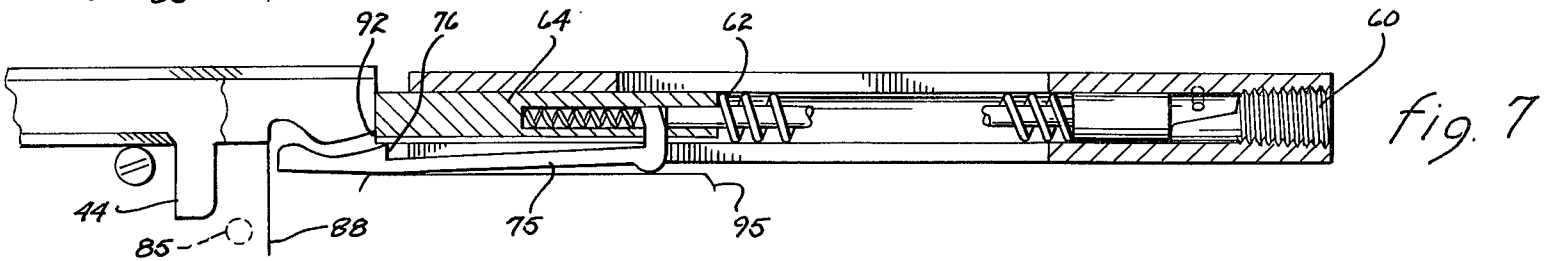

Referring to FIG. 7, it may be seen that the extractor/ejector 36 has been moved forward (to the right) forcing the anvil 64 forward against the pressure of the extractor/ejector spring 62. The sear 75 slides rearwardly in relation to the anvil 64 in the slot 67 as the anvil is moved forward. It may be noted that the sear 75, while having been moved relative to the anvil has nevertheless remained in essentially the same position relative to the remainder of the firearm. It may also be noted that the latching surface 76 of the sear 75 has not engaged the corresponding latching surface 92 of the anvil 64. The sear 75 is supported by a sear slide and pivot bench 95 which, in the embodiment chosen for illustration, is formed integrally with the barrel. With the apparatus in the position of FIG. 7, it may be seen that if the action is again broken, the extractor/ejector spring 62 will force the anvil 64 against the extractor/ejector 36, causing the latter to move rearwardly until the extension 44 contacts the flank pin 45. The rapidity with which such motion takes place is determined solely by the abruptness by which the action is broken since the extractor/ejector 36 extends rearwardly until it contacts the breech face 98. Opening the action thus generally gently extracts the cartridge by permitting the extractor/ejector 36 to move rearwardly of the barrel as the former slides along the breech face 98. This manner of extraction (i.e. extractor following the breech face as the action is broken) is typical of the prior art; however, if the cartridge in the corresponding barrel has been fired, such extraction is inadequate and ejection of the cartridge is desired.

Figure 8:
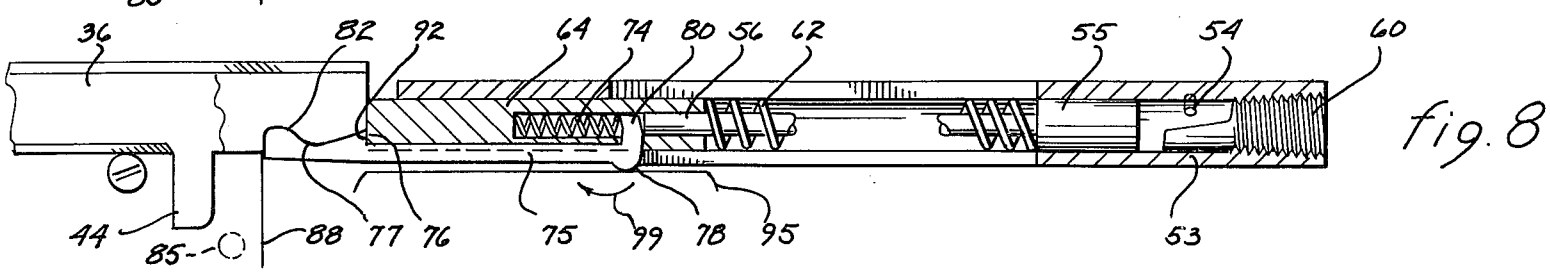

Referring now to FIG. 8, the apparatus of the present invention may be shown in the position as the cartridge in the barrel 27 is fired. The gas in the barrel 27 passes through the gas port 54 into the cylinder 53, forcing the piston 55 rearwardly (to the left). This rearward motion of the piston 55 is transmitted by the piston rod 56 to the operating arm 80 of the sear 75, thus compressing the sear spring 74 and moving the sear rearwardly relative to the anvil 64. This rearward movement is accompanied by a rotating moment generally in the direction indicated by the arrow 99 caused by the pivoting of the sear about the pivot surface 78 and the shape of the operating arm 80. The rearward movement of the sear 75 causes the latching surface 76 of the sear to engage the corresponding latching surface 92 of the anvil 64; similarly, the camming surface 77 of the sear engages the mating camming surface 82 of the rear portion of the extractor/ejector. When the gas has escaped from the barrel 27, the piston 55 will return into a butting engagement with the split end plug 60; however, the extractor/ejector spring 62 will be compressed and will be latched into such compressed condition as a result of the latching of the sear 75 to the anvil 64. As the action is broken, the initial breaking does not result in rearward movement of the extractor/ejector 36; rather the lug 85 moves into contact with the extension 44 and thereafter forces the extractor/ejector 36 to move rearwardly. This initial rearward movement causes relative movement between the mating camming surfaces 77 and 82 since the sear 75 is prevented from moving rearwardly by the leading edge 88 of the monoblock.

Relative motion of the mating camming surfaces 77 and 82 causes the downward pivoting of the sear 75 until the latching surfaces 76 and 92 disengage. At this instant, the extractor/ejector spring is still in its compressed condition and is suddenly released, propelling the anvil 64 rearwardly, which in turn rapidly propels the extractor/ejector 36 rearwardly until the extension 44 contacts the flank pin 45. The cartridge contained in the breech is thus forcefully ejected.

The elements of the apparatus, upon completion of ejection, will assume the position shown in FIG. 6. It may therefore be seen that a cartridge inserted into the breech of the barrel will be extracted by the extractor/ejector spring 62 when the action is again broken. The extraction force is applied gently since the spring 62 is permitted to expand as the action is opened as the extractor/ejector follows the breech face during the breaking action. On the other hand, if the cartridge is fired, gases from the barrel force the piston 55 to move the sear 75 rearwardly and pivot it upwardly into a latched position which effectively locks the spring in its compressed state. Subsequent breaking of the action will not be accompanied by immediate expansion of the spring. As the action opens, the sear is cammed out of its latched position, permitting the extractor/ejector spring to rapidly expand and to forcefully thrust the anvil 64 and extractor/ejector 36 rearwardly to cause ejection of the cartridge.

I claim:

1. In a break-open type firearm action having a barrel and using a gas propelled projectile fired from a cartridge held in a breech of said barrel, an extraction/ejection system comprising:

a. an extractor/ejector slidably positioned along the breech of said barrel for longitudinal movement along said barrel and including a portion thereof positioned to engage said cartridge for extracting or ejecting said cartridge from the breech of said barrel;

b. an extractor/ejector spring contacting and urging said extractor/ejector to an extracting position when said action is broken;

c. sear means for latching said spring in an energy storage position, said sear means responsive to the breaking of said action for unlatching said spring and permitting said spring to rapidly force said extractor/ejector rearward of said barrel to effectively eject said cartridge from said breech;

d. a cylinder secured to said barrel;

e. a piston slidably mounted in said cylinder;

f. a gas port in said barrel communicating with said cylinder for transporting gas under pressure from said barrel during firing of said cartridge to said cylinder to force said piston along said cylinder;

g. means connected to said piston and contacting said sear for forcing said sear to a spring latching position when said piston moves along said cylinder in response to gas pressure from said barrel.

2. In a break-open type firearm action having a barrel and using a gas propelled projectile fired from a cartridge held in a breech of said barrel, an extraction/ejection system comprising:

a. an extractor/ejector slidably positioned along the breech of said barrel for longitudinal movement along said barrel and including a portion thereof positioned to engage said cartridge for extracting or ejecting said cartridge from the breech of said barrel;

b. an extractor/ejector spring contacting and urging said extractor/ejector to an extracting position when said action is broken;

c. sear means for latching said spring in an energy storage position, said sear means responsive to the breaking of said action for unlatching said spring and permitting said spring to rapidly force said extractor/ejector rearward of said barrel to effectively eject said cartridge from said breech;

d. a gas port in said barrel for transporting gas under pressure from said barrel during firing of said cartridge; and e. means responsive to gas entering said port from said barrel for forcing said sear to a spring latched position.

3. In a break-open type firearm action having a barrel and using a gas propelled projectile fired from a cartridge held in a breech of said barrel, an extraction/ejection system comprising:

a. an extractor/ejector slidably positioned along the breech of said barrel for longitudinal movement along said barrel and including a portion thereof positioned to engage said cartridge for extracting or ejecting said cartridge from the breech of said barrel;

b. an extractor/ejector spring contacting and urging said extractor/ejector to an extracting position when said action is broken;

c. sear means for latching said spring in an energy storage position, said sear means responsive to the breaking of said action for unlatching said spring and permitting said spring to rapidly force said extractor/ejector rearward of said barrel to effectively eject said cartridge from said breech;

d. a cylinder secured to said barrel;

e. a piston slidably mounted in said cylinder;

f. a gas port in said barrel communicating with said cylinder for transporting gas under pressure from said barrel during firing of said cartridge to said cylinder to force said piston along said cylinder; and g. means responsive to the forcing of said piston along said cylinder for urging said sear to a spring latching position.

4. In a break-open type firearm action having a barrel and using a gas propelled projectile fired from a cartridge held in a breech of said barrel, an extraction/ejection system comprising:

a. an extractor/ejector slidably positioned along the breech of said barrel for longitudinal movement along said barrel and including a portion thereof positioned to engage said cartridge for extracting or ejecting said cartridge from the breech of said barrel;

b. an extractor/ejector spring contacting and urging said extractor/ejector to an extracting position when said action is broken;

c. sear means for latching said spring in an energy storage position, said sear means responsive to the breaking of said action for unlatching said spring and permitting said spring to rapidly force said extractor/ejector rearward of said barrel to effectively eject said cartridge from said breech;

d. a cylinder secured to said barrel and extending parallel thereto;

e. a piston slidably mounted in said cylinder;

f. a gas port extending through said barrel and communicating with said cylinder for transporting gas under pressure from said barrel during firing of said cartridge to said cylinder to force said piston along said cylinder; and g. a piston rod extending from said piston and contacting said sear for forcing said sear to a spring latched position when said piston moves along said cylinder in response to gas pressure from said barrel.

* * * * *